US007142162B2

(12) United States Patent
Taromaru et al.

(10) Patent No.: US 7,142,162 B2
(45) Date of Patent: Nov. 28, 2006

(54) ANTENNA STRUCTURE AND TELEVISION RECEIVER

(75) Inventors: Makoto Taromaru, Soraku-gun (JP); Takashi Ohira, Soraku-gun (JP); Takuma Sawaya, Soraku-gun (JP); Kyouichi Iigusa, Soraku-gun (JP); Hiroki Tanaka, Soraku-gun (JP); Satoru Tawara, Soraku-gun (JP); Takashi Itoh, Soraku-gun (JP); Emi Morita, Soraku-gun (JP)

(73) Assignee: Advanced Telecommunications Research Institute International, Kyoto (JP)

( * ) Notice: Subject to any disclaimer, the term of this patent is extended or adjusted under 35 U.S.C. 154(b) by 0 days.

(21) Appl. No.: 11/065,832

(22) Filed: Feb. 25, 2005

(65) Prior Publication Data

US 2005/0190110 A1 Sep. 1, 2005

(30) Foreign Application Priority Data

Mar. 1, 2004 (JP) ..... 2004-056892

(51) Int. Cl.
*H01Q 1/24* (2006.01)

(52) U.S. Cl. ..... 343/702

(58) Field of Classification Search ..... 343/702, 343/741, 742, 866, 867
See application file for complete search history.

(56) References Cited

U.S. PATENT DOCUMENTS

| | | | | |
|---|---|---|---|---|
| 5,371,509 | A * | 12/1994 | Wallace et al. | 343/741 |
| 5,838,283 | A * | 11/1998 | Nakano | 343/741 |
| 6,064,347 | A * | 5/2000 | Fordham | 343/749 |
| 6,380,898 | B1 * | 4/2002 | Moore et al. | 343/702 |
| 6,437,756 | B1 * | 8/2002 | Schantz | 343/866 |

* cited by examiner

*Primary Examiner*—Trinh Dinh
*Assistant Examiner*—Huedung Mancuso

(57) ABSTRACT

An antenna structure with reduced bulkiness and capable of changing antenna directivity is provided. In order to achieve such an effect, the antenna structure includes a feed element of one of an inverted F type and a loop type, and a passive element of one of the inverted F type and loop type, and having a variable reactor so as to be capable of changing an electrical length, and the feed element and passive element are disposed with a predetermined distance therebetween.

10 Claims, 11 Drawing Sheets

ANTENNA STRUCTURE AND TELEVISION RECEIVER

BACKGROUND OF THE INVENTION (1) Field of the Invention

The present invention relates to an antenna structure and a television receiver having the antenna structure. More specifically, it relates to a technique to electrically change directivity of the antenna structure.

(2) Description of the Related Art

Methods for adjusting receiving conditions on antennas include a mechanical adjustment method where the antennas are tilted and rotated, and an electrical adjustment method where directivity of the antennas is altered electrically without moving the antennas. Examples of the antennas employing the electrical adjustment method are such as ESPAR antennas (Patent Reference: Japanese Laid-Open Patent Application No. 2002-118414) and diversity antennas in which one of antenna elements having different directivity is selected so as to change the directivity of the diversity antenna.

Such antennas include dipole elements or monopole elements. These elements are required to be disposed either with a sufficient distance from a metal casing and a circuit substrate of a transmission apparatus, or standing on the metal casing or circuit substrate as an earth plate. This makes it inconvenient to carry about the transmission apparatus, because the dipole elements or monopole elements extend outward from the transmission apparatus.

Even if the dipole elements and monopole elements are disposed parallel to the casing of the transmission apparatus (the earth plate), bulkiness of the antenna remains, because an interval between two elements should be at least $\lambda/4$. Especially when the transmission apparatus is a thin television receiver, the bulkiness of the antenna ruins its portability and appearance. Because the television broadcast radiowaves are horizontally polarized, the dipole elements and monopole elements have to be disposed on a top of the casing of the transmission apparatus in order to be disposed parallel to the casing of the transmission apparatus (the earth plate).

On the other hand, inverted F antennas and loop antennas have been known as low profile antennas (Non-Patent Reference: Naohisa Goto, "Illustrated Text: Antenna" The Institute of Electronics, Information and Communication Engineering, 1995, pp. 225–227). It is considered that the above problem of bulkiness can be solved by employing these low profile antennas.

However, a technique to change the directivity of the inverted F antennas and loop antennas has not been established.

SUMMARY OF THE INVENTION

In view of the above problem, an object of the present invention is to introduce a technique of electrically changing the directivity of a low profile antenna such as an inverted F antenna and a loop antenna. Using such a technique, the present invention further aims to provide an antenna structure that is less bulky in shape and capable of electrically adjusting receiving conditions, and a television receiver having the antenna structure, thereby improving portability and appearance of the television receiver as a whole.

In order to achieve the above object, an antenna structure according to the present invention comprises a feed element of one of an inverted F type and a loop type; and a passive element of one of the inverted F type and loop type, including a variable reactor so as to be capable of changing an electrical length, wherein the feed element and passive element are disposed with a predetermined distance therebetween.

Further, in order to achieve the above object, a television receiver according to the present invention has a casing and the above antenna structure provided either on a back or on a side of the casing.

By the above structure, it is possible to change the electrical length of the passive element so as to switch a property of the passive element between a wave director and a reflector, by adjusting the variable reactor between its capacity and inductivity. Thus, the directivity of the feed element that disposed parallel to the passive element can be set high in a direction of the wave director, or high in an opposite direction of the reflector.

Moreover, because both of the feed element and passive element are low profile antennas of either the inverted F type or loop type, it is possible to reduce bulkiness when attaching the antenna structure to transmission apparatuses and such. This improves portability and overall appearance of the transmission apparatuses.

It is more preferable to provide more than three variable reactors or to have the variable reactor vary successively. By this, the directivity of the antenna can include three ranges, or can be altered successively, and thus the receiver sensitivity can be set in a more desirable condition.

The above antenna structure, which may be provided to the above television receiver, may further comprise an earth plate, wherein the feed element is of the inverted F type having a long conductor parallel to the earth plate and two short conductors intersecting the earth plate perpendicularly, and includes a feeding point inserted in one of the two short conductors.

By this, it is possible to reduce the bulkiness of the feed element.

The above antenna structure, which may be provided to the above television receiver, may further comprise an earth plate, wherein the passive element is of the inverted F type having a long conductor parallel to the earth plate and two short conductors intersecting the earth plate perpendicularly, and the variable reactor is inserted in one of the two short conductors.

By this, it is possible to reduce the bulkiness of the passive element, in addition to the feed element, and therefore the antenna structure as a whole can be made low profile.

The above antenna structure, which may be provided to the above television receiver, may also be any of the following antenna structures: (i) the above antenna structure wherein the passive element further includes a capacitor inserted between the earth plate and the other of the two short conductors, (ii) the above antenna structure further comprising another passive element that is identical to the passive element, wherein the two passive elements are disposed one at each side of the feed element, (iii) the above antenna structure further comprising an earth plate, wherein at least one of the feed element and the passive element is of the inverted F type having a long conductor partially parallel to the earth plate and two short conductors intersecting the earth plate perpendicularly, and an end section of the long conductor extends substantially perpendicular toward or to the earth plate, the end section not being joined to the two short conductors, (iv) the above antenna structure further comprising an earth plate, wherein the feed element is of the loop type grounded to the earth plate and having a long conductor parallel to the earth plate and two short conductors extending perpendicular toward or to the earth plate one from each end of the long conductor, and includes a feeding point inserted in one of the two short conductors, (v) the above antenna structure further comprising an earth plate, wherein the passive element is of the loop type grounded to the earth plate and having a long conductor parallel to the earth plate and two short conductors extending perpendicular toward or to the earth plate one from each end of the long conductor, and the variable reactor is inserted in one of the two short conductors, (vi) the above antenna structure wherein the variable reactor is a varicap diode, the passive element further includes a capacitor inserted between the earth plate and the other of the two short conductors, so that direct current between the long conductor and the earth plate is isolated, and the electrical length of the passive element varies along with a capacity of the varicap diode that changes upon application of a direct current potential to the long conductor, (vii) the above antenna structure wherein the feed element and passive element are of the loop type having two long conductors and two short conductors positioned so as to form a rectangular configuration, the feed element includes a feeding point inserted in one of the two short conductors, and the variable reactor is inserted in one of the two short conductors, and (viii) the above antenna structure wherein the feed element is of a twin-inverted F type having (a) a first short conductor, (b) two long conductors extending one from each end of the first short conductor perpendicularly in a same direction, and (c) a second short conductor connecting the two long conductors so as to be parallel to the first short conductor, and includes a feeding point inserted in one of the first and the second short conductors, the passive element is of a twin inverted L type having a short conductor and two long conductors extending one from each end of the first short conductor perpendicularly in the same direction, and the variable reactor is inserted in the short conductor.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

First Embodiment

The following describes preferred embodiments of the present invention with reference to the drawings.

[General Structure]

Figure 1:
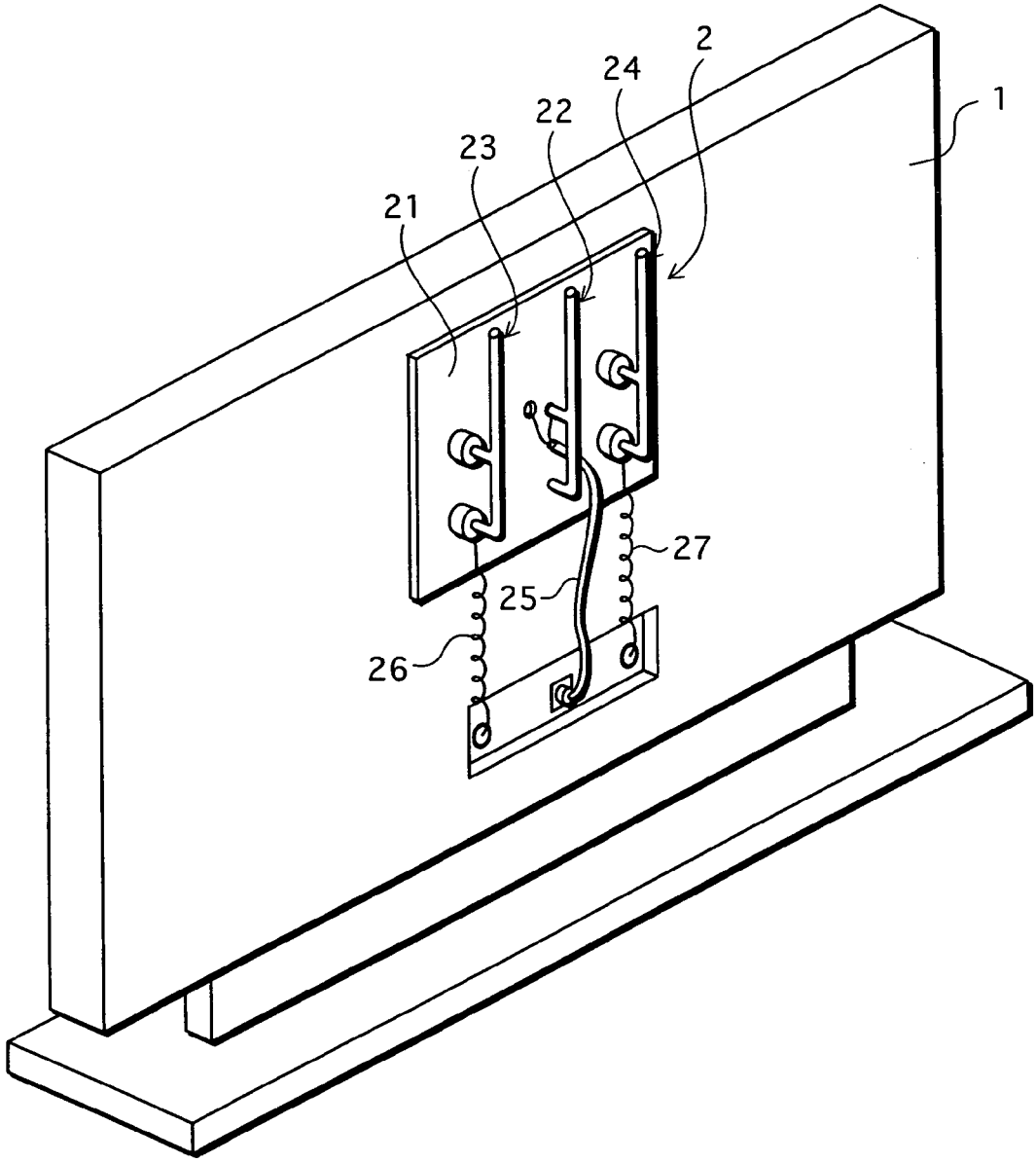
FIG. 1 illustrates an example in which an antenna structure according to the present invention is applied to a thin type television.

FIG. 1 illustrates an example in which an antenna structure according to the present invention is applied to a thin type television such as a plasma display panel. FIG. 1 shows a casing 1 of the television receiver from backward. An antenna structure 2 has such a structure in which passive elements 23 and 24 are disposed in parallel on both sides of a feed element 22 on a metal plate (herein after referred to as an earth plate) 21. The feed element 22 is connected to a tuner circuit (not depicted in the drawing) in the television receiver via a coaxial cable 25. The passive elements 23 and 24 are connected to a control circuit (not depicted in the drawing) in the television receiver via control signal lines 26 and 27. In this embodiment, both the feed element 22 and passive elements 23 and 24 are of an inverted F type.

[Structure of Antenna]

Figure 2:
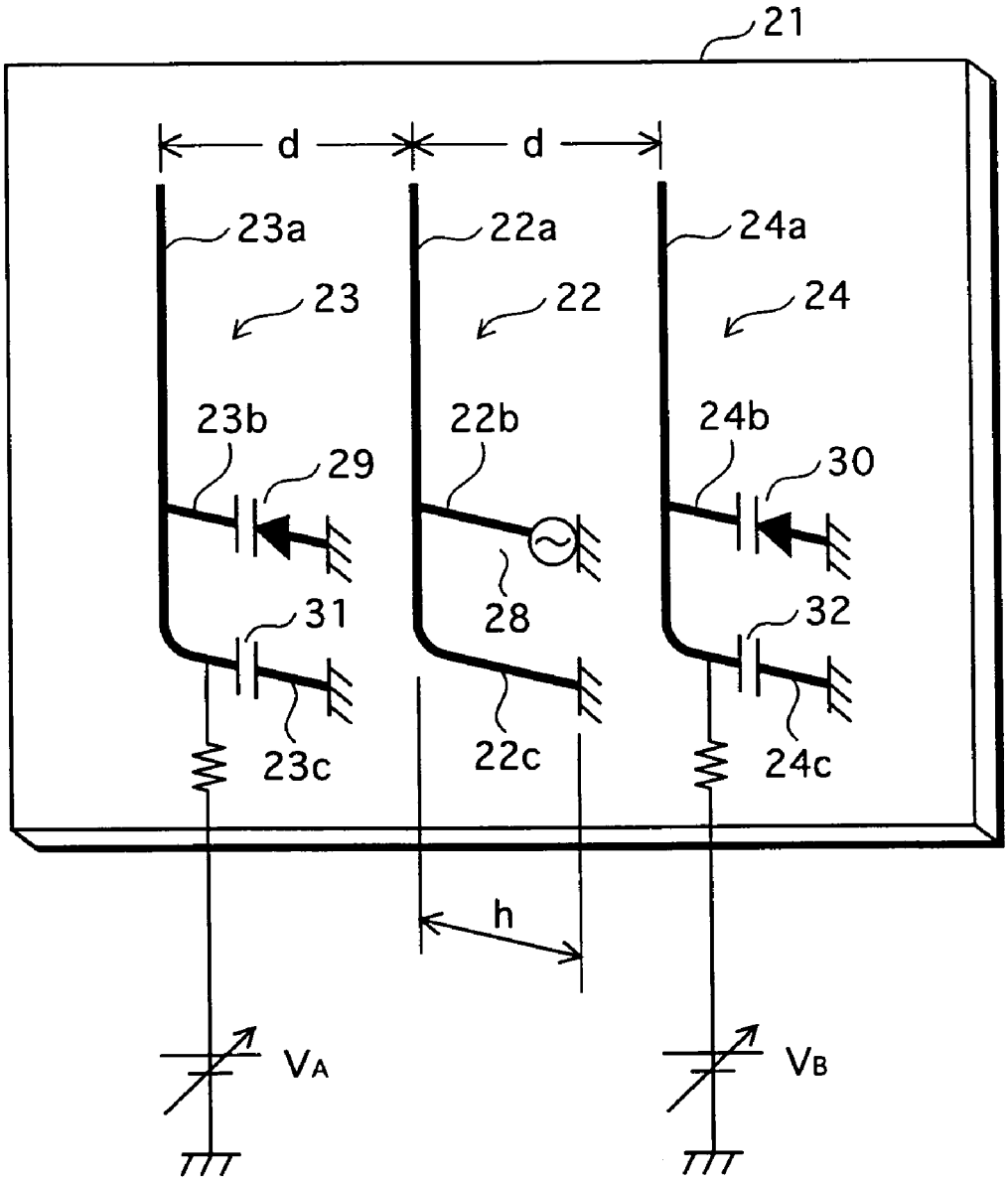
FIG. 2 is a diagram to explain basics of an antenna structure according to a first embodiment.

FIG. 2 is a diagram to explain basics of the antenna structure according to a first embodiment.

The feed element 22 includes a long conductor 22*a* that is parallel to the earth plate 21, and a first short conductor 22*b* and a second short conductor 22*c* that intersect the earth plate 21 perpendicularly. A total length of the long conductors 22*a* and second short conductor 22*c* is generally $(n/2+1/4)\lambda$, where $\lambda$ is a wavelength of transmission frequency and n is 0 or any positive integer. A length h for the first short conductor 22*b* and second short conductor 22*c* is adjusted so as to be balanced with antenna gain and acutance Q. In general, the antenna gain and acutance Q increases as $h/\lambda$ becomes smaller. It is generally preferable to set $h/\lambda$ in a range of 0.06 to 0.08, because matching properties desirable to 50 Ω and 75 Ω, which are common as feed impedance, can be obtained.

A feeding point 28 is inserted in the middle of the first short conductor 22*b*. The feeding point 28 is a tuning circuit in a precise sense. Accordingly, a coaxial cable 25 is inserted in the middle of the first short conductor 22*b* in practice. One end of the second short conductor 22*c* is grounded to the earth plate 21.

The configuration and sizes of each part of the passive elements 23 and 24 are substantially the same as the feed element 22. The passive elements 23 and 24 respectively include a long conductors 23*a* and 24*a* that are parallel to the earth plate 21, and first short conductors 23*b* and 24*b* and second short conductors 23*c* and 24*c* that extend perpendicular toward or to the earth plate 21.

A difference from the feed element 22 lies in that varicap diodes 29 and 30 are respectively inserted in the first short conductors 23*b* and 24*b* of the passive elements 23 and 24, and capacitors 31 and 32 each having a large capacitance are respectively inserted in the second short conductors 23*c* and 24*c* of the passive elements 23 and 24. Because the capacitance of the capacitors 31 and 32 is large, impedance of transmission frequencies is extremely small. The capacitors 31 and 32 are electrically continuous when alternating-current is supplied, but have the long conductors 23*a* and 24*a* electrically float on the earth plate 21 when direct-current is supplied. Because of this, control signals $V_A$ and $V_B$ from a controller of the television receiver are directly applied to the long conductors 23*a* and 24*b* without going through such as a high-frequency cut filter.

A distance d between the feed element 22 and each of the passive elements 23 and 24 is around a range of 0.1λ to 0.4λ. For example, when the transmission frequency is 600 MHz, the distance d is 5 to 20 cm, and a total length of each of the feed element 22 and the passive elements 23 and 24 is not shorter than around 12.5 cm.

Figure 3:
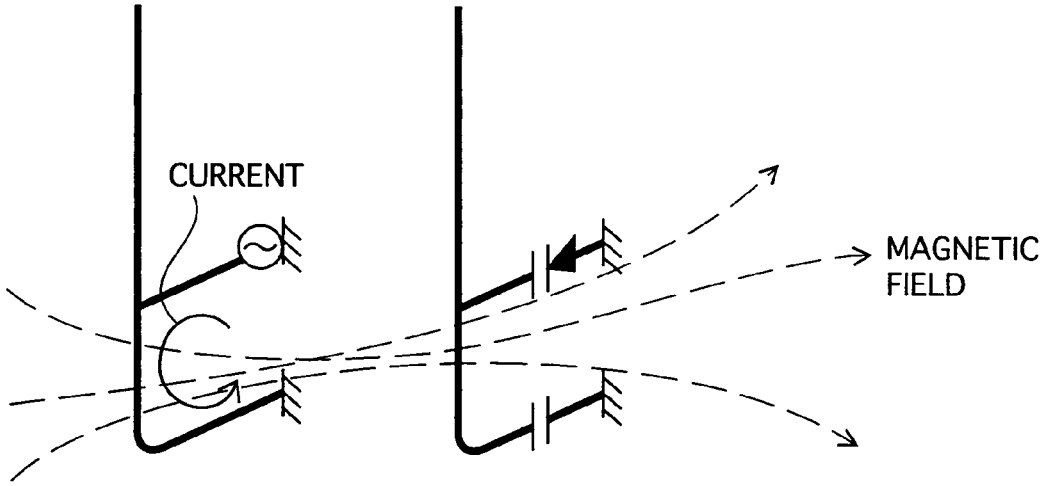
FIG. 3 is a diagram to explain an advantage of the antenna structure according to the first embodiment.

FIG. 3 is a diagram to explain advantages of the antenna structure according to the first embodiment.

As shown in FIG. 3, in the feed element 22, a magnetic field (shown by an arrow in dashed line) is generated by feed current (shown by an arrow in solid line) supplied to a closed loop structured by the conductors and the earth plate. Because the generated magnetic field passes through closed loops of the passive elements 23 and 24, the feed element and passive elements are magnetically coupled. Thus, in a case in which the elements are of the inverted F type, it is possible to establish a sufficient coupling between elements even if the distance between the feed element and passive element is wider than a case of common allay antennas. By making the distance between the feed element and passive element wide, an effective range of an antenna becomes wider, and therefore it is possible to sharpen the directivity (or narrow a half breadth) and increase a gain of the antenna.

[Operation]

In the above described antenna structure, transmitting the control signals $V_A$ and $V_B$ respectively to the passive elements 23 and 24 changes the capacity of the varicap diodes 29 and 30, and then the impedance of the transmission frequency of the first conductors 23*b* and 24*b* changes in a range from 0 to a certain value. As a result, an effect that is substantially the same as moving a short circuit point of an inverted F type antenna to the earth plate 21 along the long conductors 23*a* and 24*a* occurs, and this substantially changes the antenna length. Properties of the passive elements become of a reflector when the antenna length becomes longer than the feed element, and of a wave director when the antenna length becomes shorter than the feed element. Thus, it is possible to change the directivity of the antenna structure 2 by changing the antenna length of the passive elements 23 and 24. Further, by switching between a state in which the antenna length of the passive element 23 is long and the antenna length of the passive element 23 is short and a state in which the antenna length of the passive element 23 is short and the antenna length of the passive element 23 is long, it is possible to change the directivity of the antenna structure 2 to a large extent.

[Modified Examples of First Embodiment]

The following describes modified examples of the first embodiment, which are substantially the sameas the first embodiment in structure, but different in detail.

Figure 4:
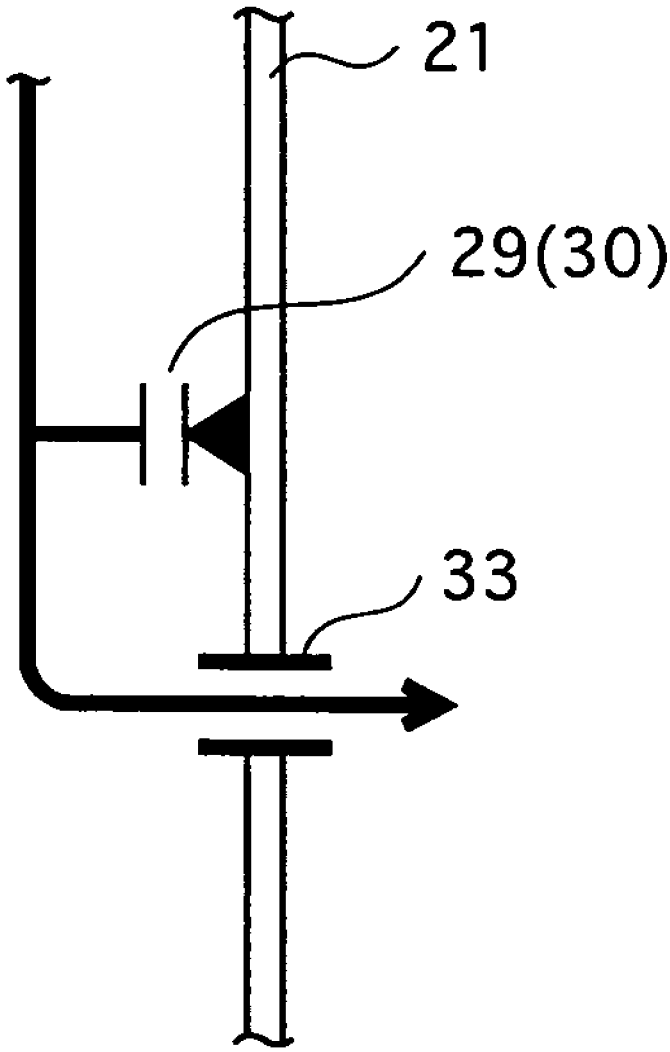
FIG. 4 illustrates a modified example of the antenna structure according to the first embodiment.

FIG. 4 illustrates a modified example of the antenna structure according to the first embodiment.

(1) As shown in FIG. 4, a feedthrough capacitor 33 is inserted in the earth plate 21, instead of providing the capacitor 31 (32) inserted in the second short conductor of the passive element 23 (24).

By this, the antenna structure can be simplified because it is not necessary to ground an end of the second short conductor to the earth plate and to insert the capacitor in the second short conductor.

Figure 5:
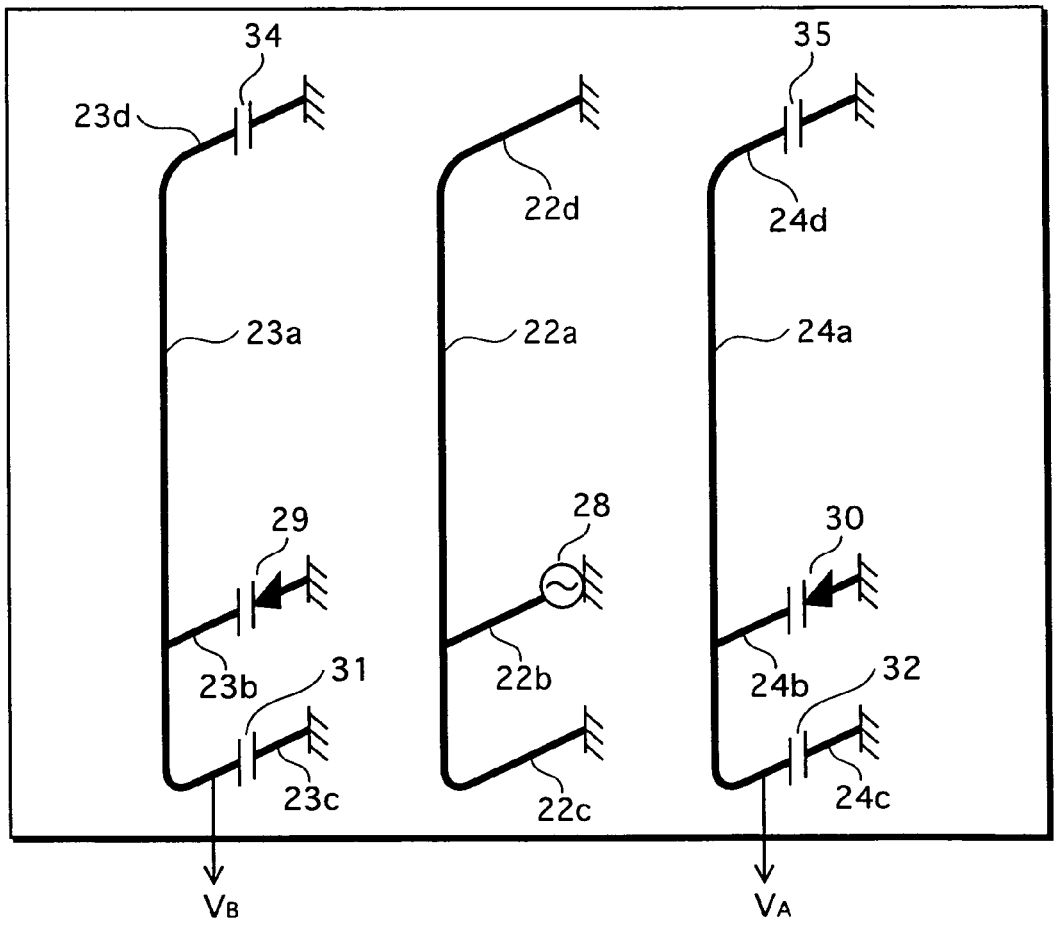
FIG. 5 illustrates another modified example of the antenna structure according to the first embodiment.

FIG. 5 illustrates a modified example 2 of the antenna structure according to the first embodiment.

(2) In the first embodiment, one end of each of the long conductors 22*a*, 23*a*, and 24*a* is an open end. In the modified example 2, an end section of the long conductors extend perpendicular to the earth plate 21 so as to be grounded. In this case, the total length of the feed element 22 and the passive elements 23 and 24 needs to be λ/2. Further, for the passive elements 23 and 24, it is necessary to insert the capacitors 34 and 35 having a large capacity in end sections 23*d* and 24*d*, in order to direct current is isolated between the long conductors and earth plate 21. Other than this, the modified example 2 has substantially the same structure as the second embodiment. Note that it is also possible to employ the feedthrough capacitors instead of the capacitors 34 and 35 as in the first modified example. Further, instead of using the capacitors 34 and 35, the sections 23*d* and 24*d* may be positioned slightly floating above the earth plate.

Figure 6:
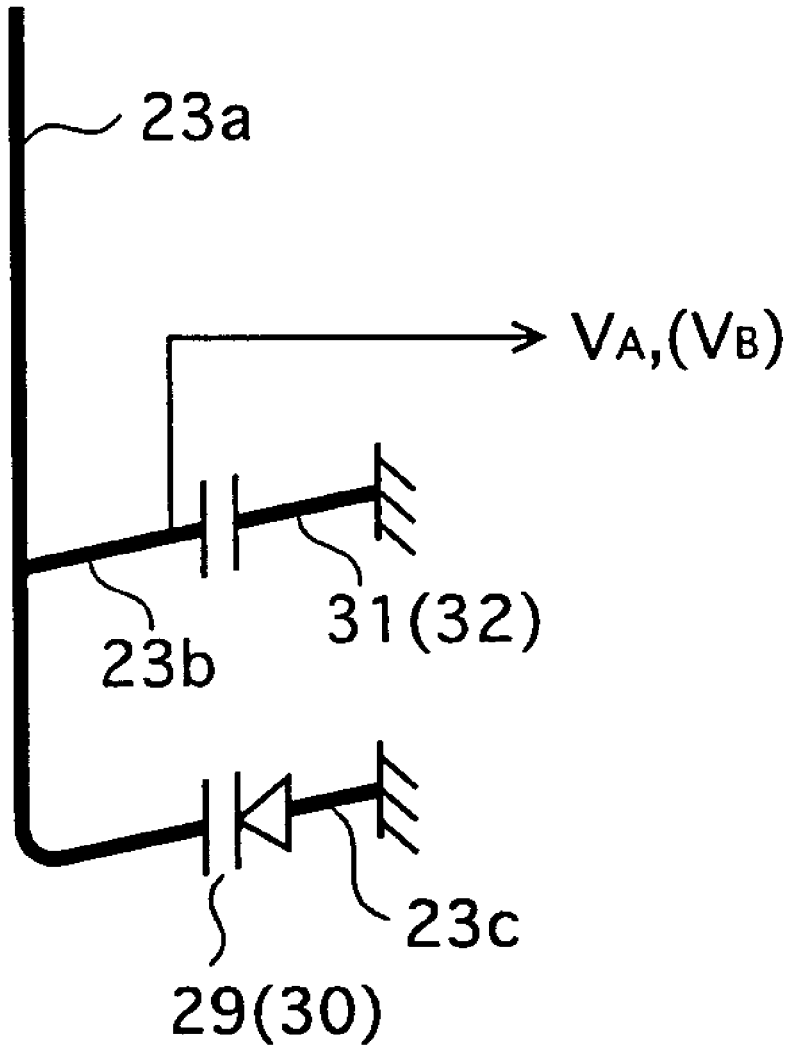
FIG. 6 illustrates yet another modified example of the antenna structure according to the first embodiment.

FIG. 6 illustrates a modified example 3 of the antenna structure according to the first embodiment.

(3) As shown in FIG. 6, the varicap diode 29 (30) is inserted in the second short conductor 23*c* (24*c*) instead of the capacitor 31 (32), and the capacitor 31 (32) is inserted in the first short conductors 23*b* (24*b*) instead of the varicap diode 29 (30). This is an opposite of the structure shown in FIG. 2. In the modified example 3, it is also possible to make the antenna structure less bulky and capable of changing the directivity, as in the other modified examples.

Figure 7A:
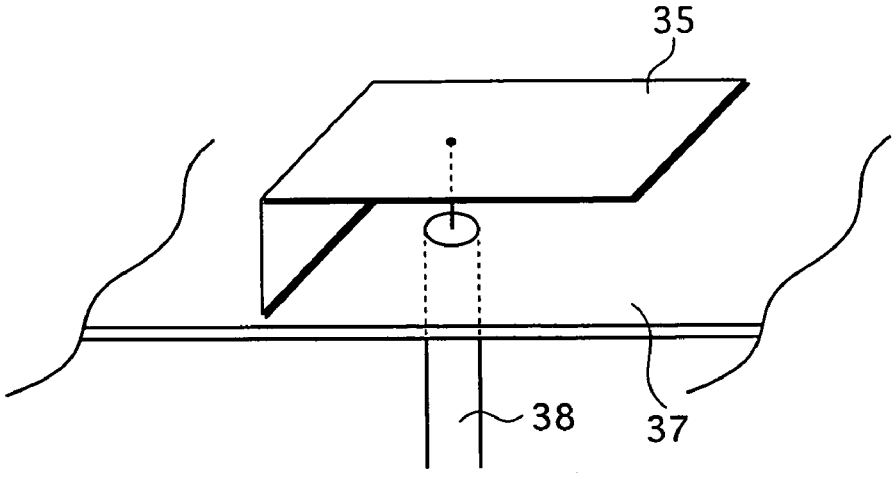
FIGS. 7A–7C each illustrate a different modified example of the antenna structure according to the first embodiment.
Figure 7B:
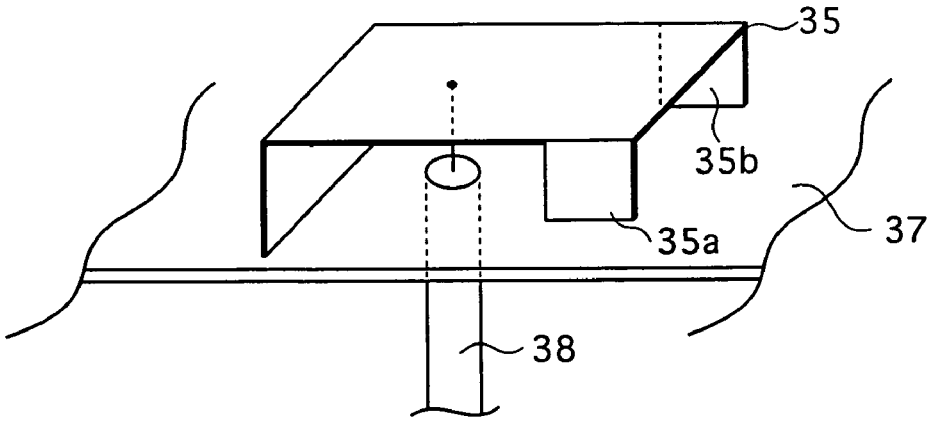
Figure 7C:
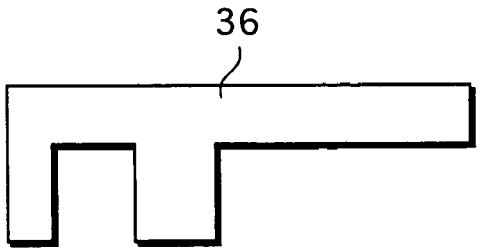

FIGS. 7A–7C each illustrates a different modified example of the antenna structure according to the first embodiment.

(4) As shown in FIG. 7A, an entire feed element 22 is structured by a metal plate 35. By this, the antenna structure is similar to a rectangular patch antenna, and accordingly, performance in radio reception increases. The drawing also shows an earth plate 37 and a coaxial cable 38 that is connected to the feeding point.

(5) As shown in FIG. 7B, ears 35*a* and 35*b* are formed at rim portions of the metal plate 35. By forming the ears, the electromagnetic field distribution around the metal plate 35 is disturbed, and therefore electrical coupling between elements becomes stronger. By this, it is possible to position the elements with a wider distance therebetween.

(6) As another variation of the example shown in FIG. 7A, FIG. 7C shows a F shaped member made by punching out a metal plate such as copper. Both the feed element and passive elements are in the same shape, and disposed on the earth plate in the same way as shown in FIG. 2. Application of the punched metal plate is suitable for mass production and the production cost can be reduced. Thus, a practical applicability of this type of variation is high. It is also possible to use a printed board, instead of the punched metal plate.

Second Embodiment

In the above first embodiment and its modified examples, the antenna elements are of the inverted F type. In a second embodiment, however, the antenna elements are of a loop type.

Figure 8:
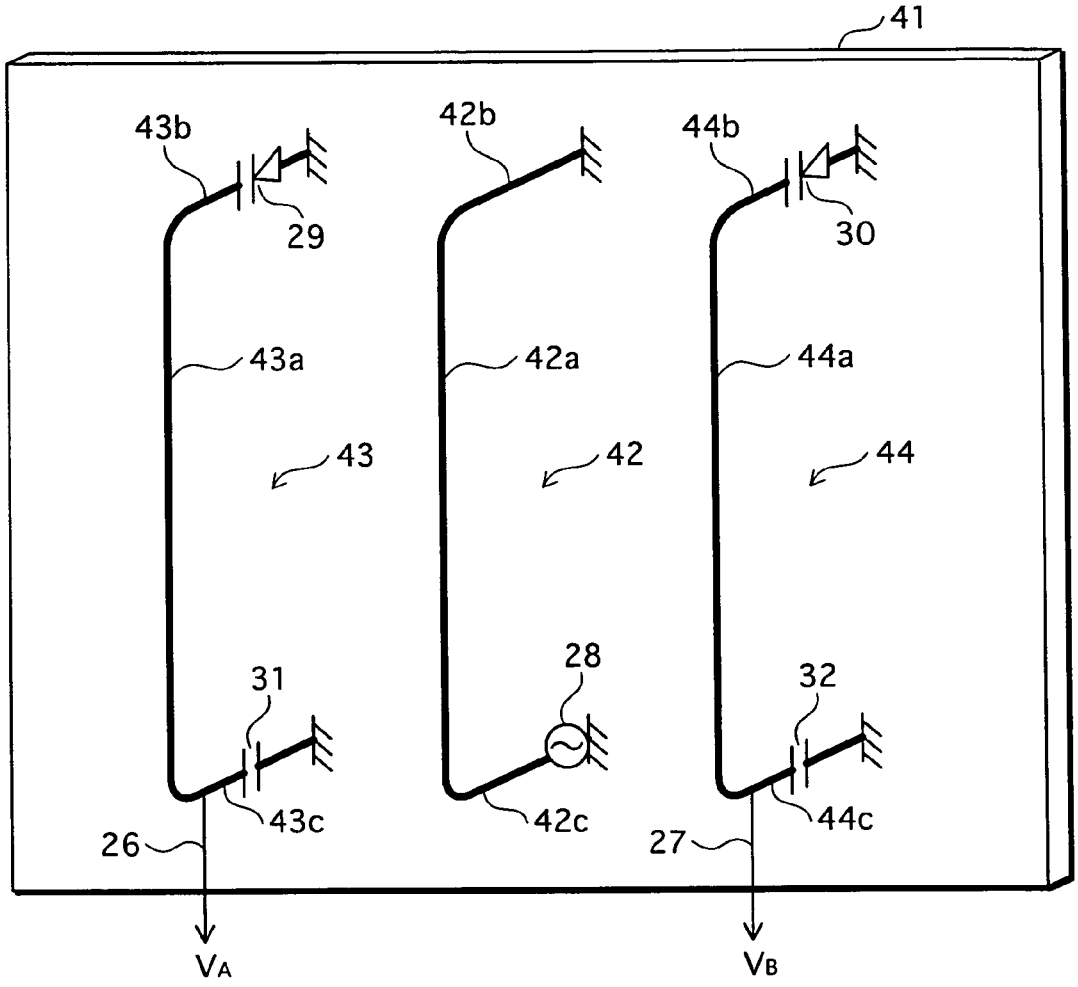
FIG. 8 is a diagram to explain basics of an antenna structure according to a second embodiment.

FIG. 8 is a diagram to explain basics of an antenna structure according to the second embodiment.

FIG. 8 shows an earth plate 41, a feed element 42, and passive elements 43 and 44. The feed element 42 and passive elements 43 and 44 are respectively including long conductors 42*a*, 43*a*, and 44*a* that are parallel to the earth plate 41 and two short conductors 42*b* and 42*c*, 43*b* and 43*c*, and 44*b* and 44*c* that extend perpendicular to the earth plate one from each end of the conductors 42*a*, 43*a*, and 44*a*. The total length of each element is $n\lambda/2$. As can be understood by the so-called electric image method, these elements are equivalence of loop antennas.

The feeding point 28 is connected to the short conductor 42*c* of the feed element 42. The varicap diodes 29 and 30 are connected respectively to the short conductors 43*b* and 44*b* of the passive elements 43 and 44. The capacitors 31 and 32 are inserted respectively in the short conductors 43*c* and 44*c*.

The mechanism of the capacitors, and having the passive elements 43 and 44 work as the wave director and/or reflector by varying the capacity of the varicap diodes are the same as in the case in which the antenna elements are of the inverted F type. Therefore the explanation is not given here.

[Modified Examples of Second Embodiment]

Figure 9:
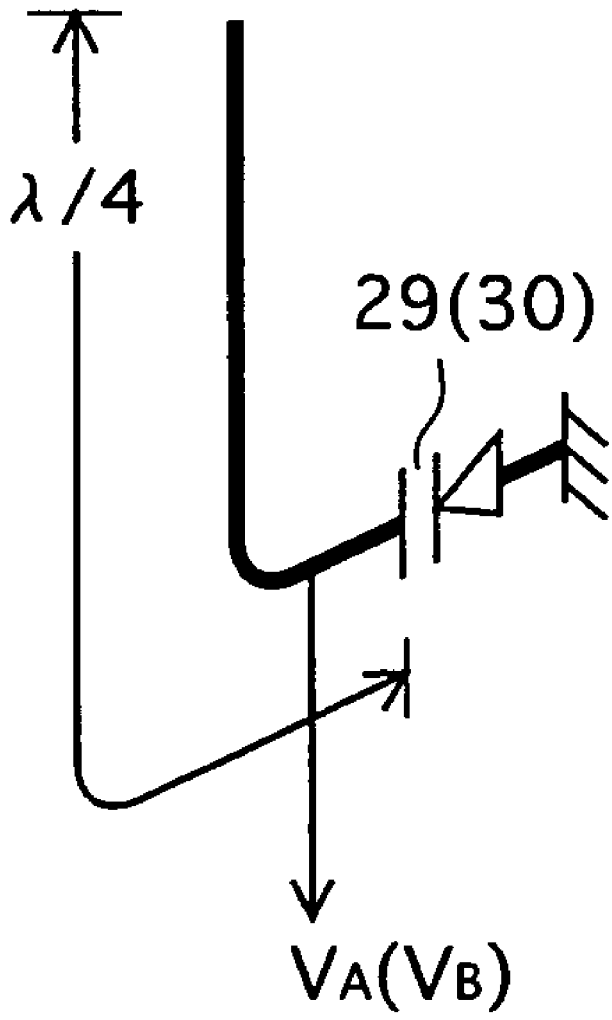
FIG. 9 illustrates a modified example of the antenna structure according to the second embodiment.

FIG. 9 illustrates a modified example of the antenna structure according to the second embodiment.

(1) FIG. 9 illustrates one of the passive elements. The total length of the passive element is $n\lambda/4$, and one end of the passive element is an open end. Although the feed element is not depicted in the drawing, the feed element of the first modified example of the second embodiment is substantially in the same structure as the passive element illustrated by FIG. 9, other than that the feed element includes the feeding point, instead of the varicap diode.

The above structure in which the antenna length is half as long as the length of the elements of the second embodiment and an open end is included is also equivalent to the elements of the second embodiment, as can be understood by the so-called electric image method.

Figure 10:
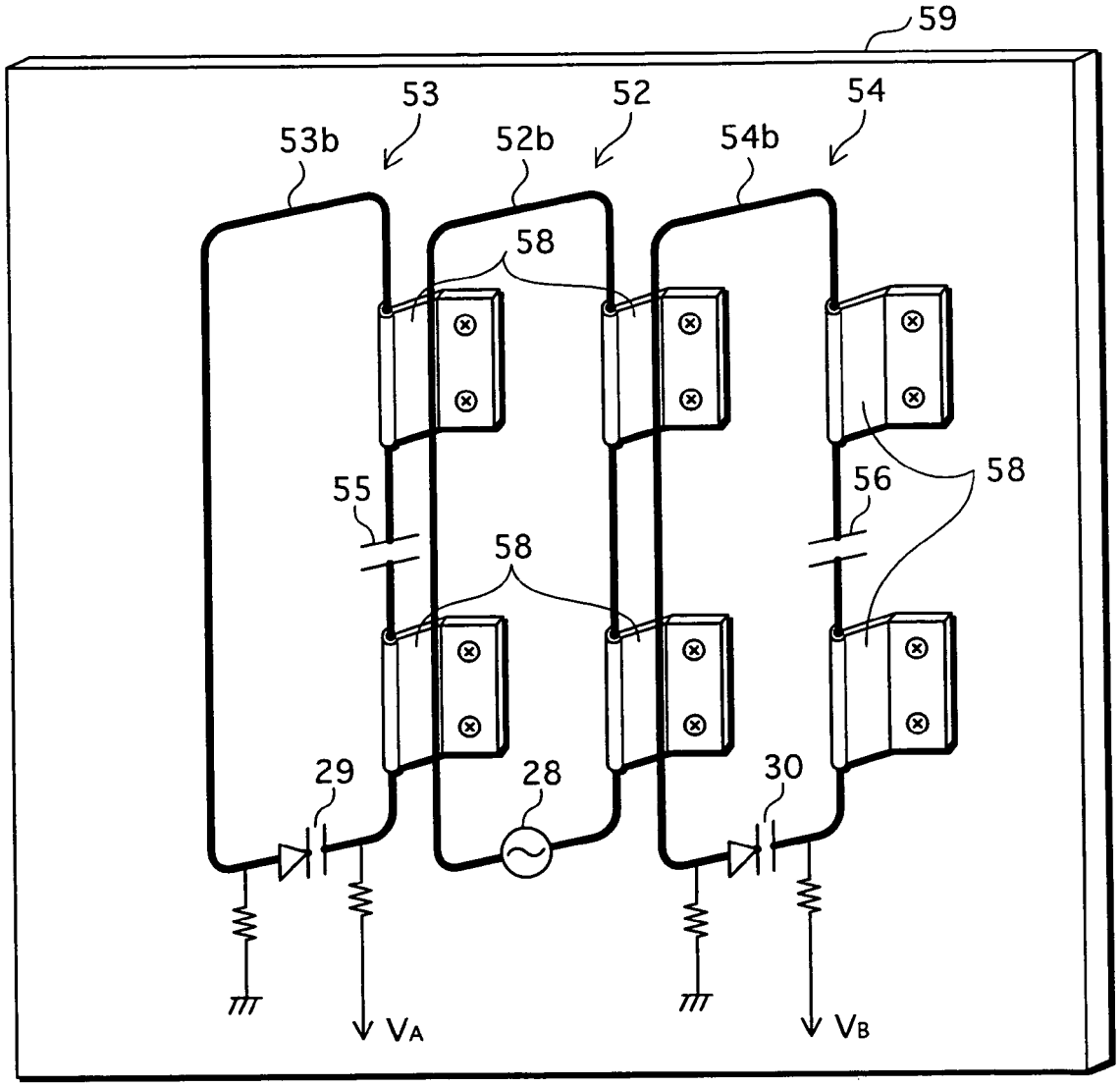
FIG. 10 illustrates another modified example of the antenna structure according to the second embodiment.

FIG. 10 illustrates another modified example of the antenna structure according to the second embodiment.

(2) As shown in FIG. 10, the feed element 52 and passive elements 53 and 54 are of the loop antenna type. In such an antenna structure, an earth plate is not included. These elements are also equivalence of the elements of the second embodiment, as can be understood by the so-called electric image method. Therefore, the total length of the loop is $\lambda$, and the short conductors 52*b*, 53*b*, and 54*b* are twice as long as the short conductors 42*b*, 42*c*, 43*b*, 43*c*, 44*b*, and 44*c*. The capacitors 55 and 56 are inserted so that the direct current does not flow. The desirable position of the capacitors 55 and 56 is at the middle of the long conductors, because high frequency current is low at the middle of the long conductor and the capacitors can be of a low capacity. By this, the production cost can be reduced because even a stranded lead-wire with insulation coating is sufficient for the capacitors. FIG. 10 also shows a holding member 58 for holding the feed element 52 and passive elements 53 and 54 with an adequate distance from a wall 59. The wall does not have to be an earth plate, as opposed to the previously explained embodiments and modified examples. The electrical properties of the elements of this modified example are the same as the embodiment 2.

Third Embodiment

Figure 11:
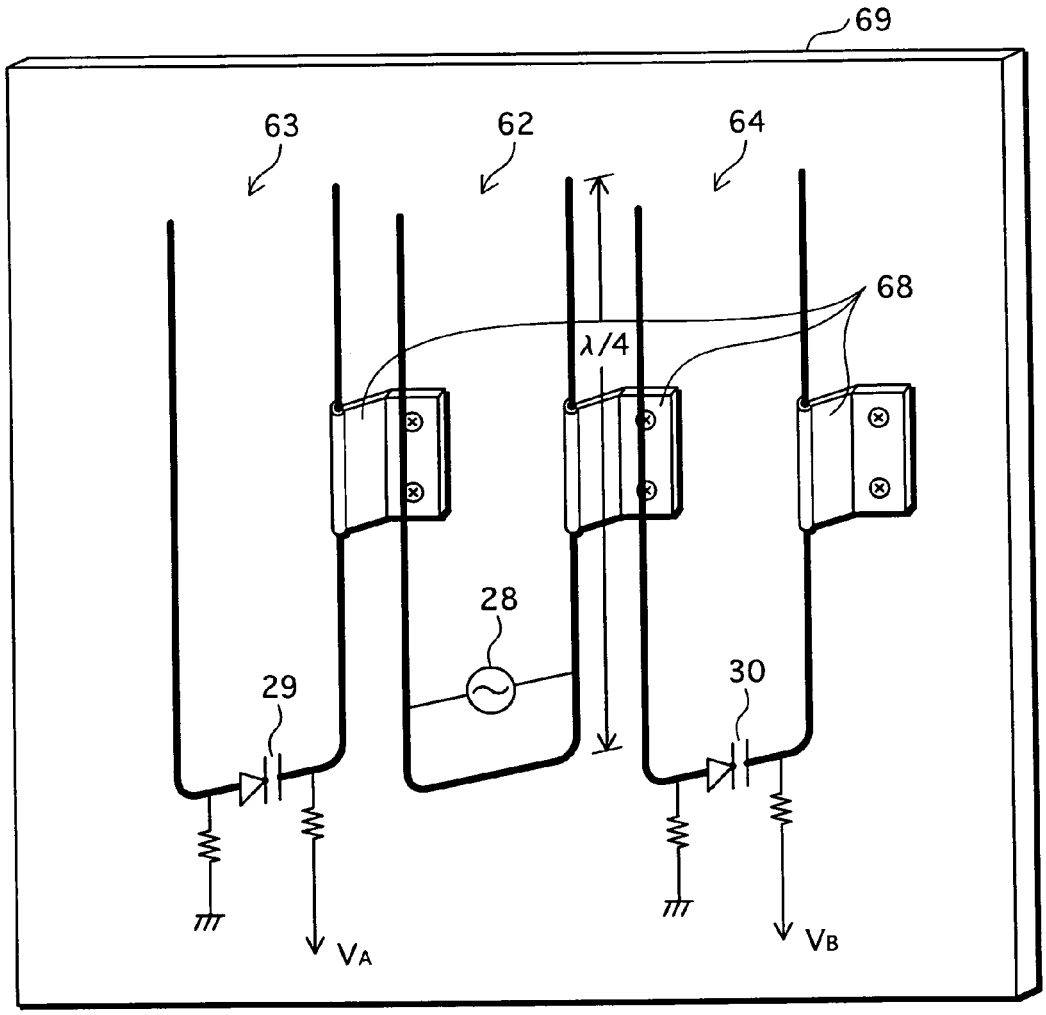
FIG. 11 is a diagram to explain basics of an antenna structure according to a third embodiment.

FIG. 11 is a diagram to explain basics of an antenna structure according to a third embodiment.

As shown in FIG. 11, a difference from the other embodiments here lies in that a feed element 62 is of a twin-inverted F type and passive elements 63 and 64 are of a twin-inverted L type. An actual shape of the element is similar to a bottom part of the elements shown in FIG. 10 after an upper part of the long conductors is cut at the middle of the long conductors where the current flows through the loop becomes almost 0. Therefore, a current distribution and impedance in this embodiment is equivalent to the example shown in FIG. 10. In that regard, the twin-inverted F type and twin-inverted L type can be included in variations of the loop type.

The feed element 62 is of the inverted F type as in the case of the first embodiment. FIG. 11 also shows holding members 68 for holding the feed element 62 and passive elements 63 and 64 with an adequate distance from a wall 69.

Finally, although the shape of the feed element is the same as the shape of the passive elements in the above embodiments and examples, the shape of the elements of the present invention is not limited to such a case. The present invention can be put into practice by making the feed element to be of the inverted F type, and the passive elements to be of the loop type, the twin-inverted F type, or the twin-inverted L type. Further, one of the passive elements can be of the loop type, and the other passive element can be of the twin-inverted F type or the twin-inverted L type. Moreover, the antenna structure of the present invention may include only one passive element disposed on either side of the feed element. Even in this case, it is also possible to change the directivity of the antenna by switching the property of the passive element between the wave director and reflector. Further, the antenna structure of the present invention may include more than three passive elements. In addition, when the antenna structure of the present invention is attached to the television receiver, the antenna structure may be attached to a side surface of the casing, instead of a back surface as shown in FIG. 1. It is sufficient if the antenna structure is attached to the television receiver so as to be able to receive horizontally polarized radiowaves.

INDUSTRIAL APPLICABILITY

The present invention may be applied to all kinds of television receivers, and provides an antenna structure that is less bulky without extensions and capable of electrically adjusting a receiving condition of the antenna so as to be attached closely to a casing or a metal plate of the television receivers. Such an antenna structure would contribute to improve performance of the television receivers, such as reducing size and weight of the television receivers, and as well as portability and appearance thereof.

Further, the antenna structure according to the present invention may be applied to all kinds of receiving apparatus, in addition to the television receivers.

Thus, an industrial applicability of the antenna structure according to the present invention is significant.

What is claimed is:

1. An antenna structure comprising:

a feed element of an inverted F type;

a passive element of the inverted F type, including a variable reactor so as to be capable of changing an electrical length; and an earth plate, wherein the feed element and passive element are disposed with a predetermined distance therebetween, and the feed element is of the inverted F type having a long conductor parallel to the earth plate and two short conductors intersecting the earth plate perpendicularly, and includes a feeding point inserted in one of the two short conductors.

2. An antenna structure according to claim 1, wherein;

the passive element is of the inverted F type having a long conductor parallel to the earth plate end two short conductors intersecting the earth plate perpendicularly, and the variable reactor is inserted in one of the two short conductors.

3. An antenna structure according to claim 2, wherein the passive element further includes a capacitor inserted between the earth plate and the other of the two short conductors.

4. An antenna structure according to claim 1, further comprising:

another passive element that is identical to the passive element, wherein the two passive elements are disposed one at each side of the feed element.

5. An antenna structure according to claim 1, wherein an end section of the long conductor extends substantially perpendicular toward or to the earth plate, the end section not being joined to the two short conductors.

6. An antenna structure comprising:

a feed element of a loop type;

a passive element of the loop type, including a variable reactor so as to be capable of changing an electrical length; and an earth plate, wherein the feed element and passive element are disposed with a predetermined distance therebetween, and the feed element is of the loop type grounded to the earth plate and having a long conductor parallel to the earth plate and two short conductors extending perpendicular toward or to the earth plate one from each end at the long conductor, and includes a feeding point inserted in one of the two short conductors.

7. An antenna structure according to claim 6, wherein the passive element is of the loop type grounded to the earth plate and having a long conductor parallel to the earth plate and two short conductors extending perpendicular toward or to the earth plate one from each end of the long conductor, and the variable reactor is inserted in one of the two short conductors.

8. An antenna structure according to claim 7, wherein the variable reactor is a variable diode, the passive element further includes a capacitor inserted between the earth plate and the other of the two short conductors, so that direct current between the long conductor and the earth plate is isolated, and the electrical length of the passive element varies along with a capacity of the varicap diode that changes upon application of a direct current potential to the long conductor.

9. An antenna structure, comprising:

a feed element of a loop type; and a passive element of the loop type, including a variable reactor so as to be capable of changing an electrical length, wherein the feed element and passive element are disposed with a predetermined distance therebetween, the feed element and passive element are of the loop type having two long conductors and two short conductors positioned so as to form a rectangular configuration, the feed element includes a feeding point inserted in one of the two short conductors, and the variable reactor is inserted in one of the two short conductors.

10. An antenna structure, comprising:

a feed element of a loop type; and a passive element of the loop type, including a variable reactor so as to be capable of changing an electrical length, wherein the feed element and passive element are disposed with a predetermined distance therebetween, the feed element is of a twin-inverted F type having (a) a first short conductor, (b) two long conductors extending one from each end of the first short conductor perpendicularly in a same direction, and (c) a second short conductor connecting the two long conductors so as to be parallel to the first short conductor, and includes a feeding point inserted in one of the first and the second short conductors, the passive element is of a twin inverted L type having a short conductor and two long conductors extending one from each end of the first short conductor perpendicularly in the same direction, and the variable reactor is inserted in the short conductor.

* * * * *